US005935748A

United States Patent [19]

Yu et al.

[11] Patent Number: 5,935,748

[45] Date of Patent: Aug. 10, 1999

[54] MECHANICALLY ROBUST ANTI-CURL LAYER

[75] Inventors: Robert C. U. Yu, Webster; Richard L. Post, Penfield, both of N.Y.

[73] Assignee: Xerox Corporation, Stamford, Conn.

[21] Appl. No.: 09/121,168

[22] Filed: Jul. 23, 1998

[51] Int. Cl.[6] ..... G03G 5/02; G03G 5/04

[52] U.S. Cl. ..... 430/58; 430/56; 430/930; 428/412

[58] Field of Search ..... 430/56, 58, 533, 430/930; 428/412

[56] References Cited

U.S. PATENT DOCUMENTS

| | | | |
|---|---|---|---|
| Re. 33,724 | 10/1991 | Takei et al. | 430/59 |
| 3,495,984 | 2/1970 | Vanpoecke et al. . | |
| 3,725,070 | 4/1973 | Hamb et al. . | |
| 3,793,249 | 2/1974 | Hamb et al. . | |
| 3,856,751 | 12/1974 | Wilson . | |
| 4,654,284 | 3/1987 | Yu et al. | 430/59 |
| 4,865,934 | 9/1989 | Ueda et al. | 430/59 |
| 4,942,105 | 7/1990 | Yu | 430/59 |
| 4,943,508 | 7/1990 | Yu | 430/58 |
| 5,008,167 | 4/1991 | Yu | 430/56 |
| 5,021,309 | 6/1991 | Yu | 430/930 |
| 5,051,328 | 9/1991 | Andrews et al. | 430/56 |
| 5,069,993 | 12/1991 | Robinette et al. | 430/58 |
| 5,545,499 | 8/1996 | Balthis et al. | 430/59 |
| 5,554,473 | 9/1996 | Cais et al. | 430/59 |
| 5,707,767 | 1/1998 | Yu | 430/56 |

OTHER PUBLICATIONS

Bayer Brochure "ATI 967 d,e", entitled Application Technology Information, APEC® HT for solubility applications.

*Primary Examiner*—Roland Martin

[57] ABSTRACT

An electrostatographic imaging member including an anti-curl layer, a supporting substrate having an electrically conductive layer, at least one imaging layer, an optional ground strip layer and an optional overcoating layer, the anti-curl layer including a film forming polymer binder selected from the group consisting of a polymer represented by the following structural formula:

wherein m is an integer between about 100 and about 800 and X is selected from the group consisting of a halogen atom, a linear substituted or unsubstituted alkyl group containing 1 to 6 carbon atoms, and a substituted or unsubstituted cyclohexyl ring, and a polymer represented by the following structural formula:

wherein p is an integer between about 100 and about 800 and X is selected from the group consisting of a halogen atom, a linear substituted or unsubstituted alkyl group containing 1 to 6 carbon atoms, and a substituted or unsubstituted cyclohexyl ring, and blends of these polymers, a copolyester adhesion promoter and dispersed particles selected from the group consisting of inorganic particles, organic particles and mixtures.

20 Claims, 1 Drawing Sheet

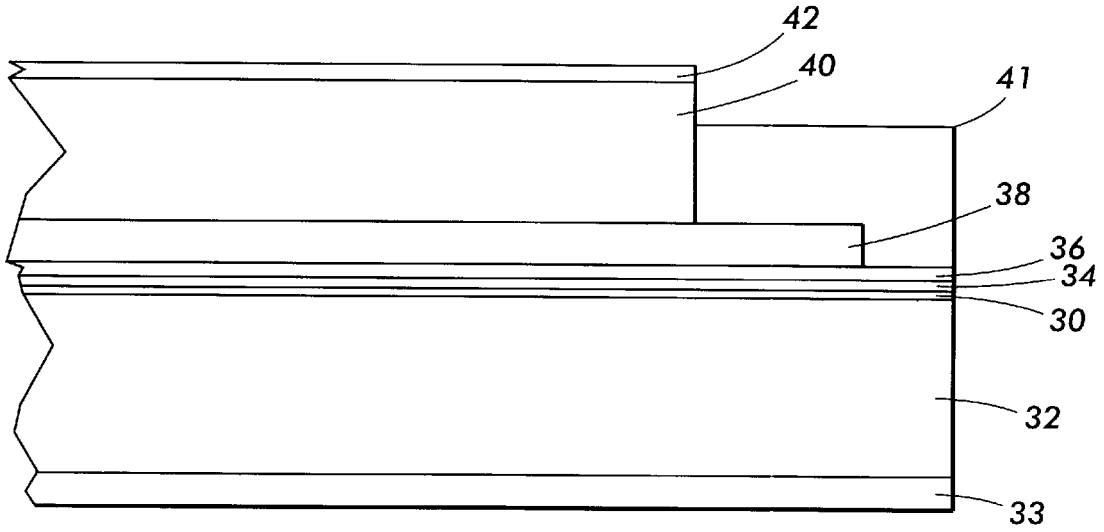
42
40
41
38
36
34
30
32
33

MECHANICALLY ROBUST ANTI-CURL LAYER

BACKGROUND OF THE INVENTION

This invention relates in general to electrostatography and, more specifically, to a flexible electrostatographic imaging member having an improved anti-curl backing layer.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. Generally, where the two electrically operative layers are positioned on an electrically conductive layer with the photoconductive layer sandwiched between a contiguous charge transport layer and the conductive layer, the outer surface of the charge transport layer is normally charged in the dark with a uniform negative electrostatic charge and the conductive layer is utilized as a positive electrode. The photoconductive layer is capable of photogenerating holes and injecting the photogenerated holes into the contiguous charge transport layer. The charge transport layer in this embodiment must be capable of supporting the injection of photogenerated holes from the photoconductive layer and transporting the holes through the charge transport layer. In flexible electrophotographic imaging members, the electrode is normally a thin conductive coating supported on a thermoplastic resin web. Obviously, the conductive layer may also function as a negative electrode when the charge transport layer is sandwiched between the conductive layer and a photoconductive layer which is capable of photogenerating electron/hole pairs and injecting the photogenerated holes into the charge transport layer when the imaging member surface is uniformly charged with a positive charge while the conductive layer beneath serves as a negative electrode to receive the injecting holes. The charge transport layer in this embodiment, again, is capable of supporting the injection of photogenerated holes from the photoconductive layer and transporting the holes through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirely. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member tends to curl. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. Coatings may be applied to the side of the supporting substrate opposite the photoconductive layer to counteract the tendency to curl. However, difficulties have been encountered with these anti-curl coatings. Anti-curl layers will also occasionally delaminate due to poor adhesion to the supporting substrate. Delamination is particularly troublesome in high speed automatic copiers, duplicators and printers which require extended cycling of the photoreceptor belt. For example, delamination has occurred in as few as 8,000 cycles. Moreover, delamination is accelerated when the belts are cycled around small diameter rollers and rods.

Since the anti-curl coating is an outermost exposed layer, it has further been found that during cycling of the photoconductive imaging member in electrophotographic imaging systems, the relatively rapid wearing away of the anti-curl coating also results in the curling of the photoconductive imaging member. In some tests, the anti-curl coating was completely removed in 150 thousand to 200 thousand cycles. This erosion problem is even more pronounced when photoconductive imaging members in the form of webs or belts are supported in part by stationary guide surfaces which causes the anti-curl layer to wears away very rapidly and produce debris which scatters and deposits on critical machine components such as lenses, corona charging devices and the like, thereby adversely affecting machine performance.

When a production web stock of several thousand feet of coated multilayered photoreceptor is rolled up, the charge transport layer and the anti-curl layer are in intimate contact. The high surface contact friction of the charge transport layer against the anti-curl layer causes dimples and creases to develop in the internal layers of the photoreceptor. These physically induced defects manifest themselves as print defect in xerographic copies.

Attempts have been made to overcome the above problems. However, the solution of one problem often leads to additional problems. For example, although the addition of micro-crystalline silica, at a 10 weight percent level in the anti-curl layer has been found to decrease charge transport layer/anti-curl layer surface contact friction and enhance wear resistance of the anti-curl layer, excessive welding horn wear is observed when this electrophotographic imaging member belt is fabricated by the ultrasonically welding of overlapped ends of an imaging member sheet. This wear is the result of the horn contacting the melted anti-curl layer and charge transport layer material when this molten mass is ejected to form splashing on either side of the seam overlap.

It has also been observed that when conventional belt photoreceptors using a bisphenol A polycarbonate anti-curl backing layer are extensively cycled in precision electrostatographic imaging machines utilizing belt supporting backer bars and ROS exposure systems, an audible squeaky sound is generated due to high contact friction interaction between the anti-curl layer and the backer bars. Further, undesirable defect print marks are formed on copies as a result of localized cumulative deposition of anti-curl layer debris onto the backer bars which forces the photoreceptor upwardly and interferes with the toner image development process. Because the anti-curl layer wear causes debris accumulation on the backer bars to gradually increase the dynamic contact friction between these two interacting surfaces, the duty cycle of the driving motor is gradually increased to a point where the motor eventually stalls and belt cycling prematurely ceases.

INFORMATION DISCLOSURE STATEMENT

U.S. Pat. No. 5,069,993 issued to Robinette et al on Dec. 3, 1991—An exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed, for example in column 12, lines 57–65.

U.S. Pat. No. 5,021,309 issued to Yu on Jun. 4, 1991—In an electrophotographic imaging device, material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 4,942,105 issued to Yu on Jul. 17, 1990—A flexible electrophotographic imaging member comprising at least one electrophotographic imaging layer, a supporting substrate layer having an electrically conductive surface and an anti-curl layer, the anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-1-propane diol. This flexible electrophotographic imaging member is cycled in an electrostatographic imaging system to produce toner images.

U.S. Pat. No. 4,654,284 issued to Yu et al. on Mar. 31, 1987—An electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of Vitel PE 100 in the anti-curl layer is described, for example, in the Working Examples.

U.S. Pat. Reissue 33,724 issued to Takei et al. on Oct. 22, 1991—A photoreceptor is disclosed comprising a photosensitive layer and a support, wherein said photosensitive layer contains a polycarbonate compound binder selected from the group consisting of Formulae A and B, wherein R1 and R2 are independently hydrogen, substituted or unsubstituted aliphatic, or a substituted or unsubstituted hydrocarbon ring, provided that at least one of R1 and R2 has at least 3 carbon atoms. Z represents a group of atoms necessary to constitute a substituted or unsubstituted carbon ring or a substituted or unsubstituted heterocyclic ring, R3 to R10 in formulas A and B are independently hydrogen, halogen, substituted or unsubstituted aliphatic or a substituted or unsubstituted hydrocarbon ring and n is a number from 10 to 1000.

U.S. Pat. No. 5,545,499 to Vernon M. Balthis, et al., issued Aug. 13, 1996—A photoconductor for use in electrophotographic reproduction devices is disclosed. This photoconductor exhibits improved oil resistance when used with liquid toners and excellent cycling stability. The photoconductors utilize a phthalocyanine dye, particularly an X-form metal-free phthalocyanine, dispersed in a medium molecular weight polyvinyl chloride binder in the charge generating layer, and charge transport molecule, particularly a hydrazone such as DEH, in a polyestercarbonate binder in the charge transport layer. U.S. Pat. No. 4,865,934 to Hideaki Ueda, et al., issued Sep. 12, 1989—A photosensitive member is disclosed which has a charge generating layer comprising specific phthalocyanine as a charge generating material and specific resin as a binder, and/or a charge transporting layer comprising specific hydrazone compounds as a charge transporting material and dyes as an absorbent for undesired lights.

U.S. Pat. No. 5,554,473 to Rudolf E. Cais, et al., issued Sep. 10, 1996—Organic photoconductive imaging receptors are disclosed in which the charge transport layer contains as a binder, a copolycarbonate of 1,1-bis-(4-hydroxyphenyl)-3,3,5-trimethylcyclohexane and 2,2,-bis-(4-hydroxylphenyl) propane exhibit excellent wear resistance.

U.S. Pat. No. 3,856,751 issued to Wilson on Dec. 24, 1974—A polyester for use as a photographic element is formed by the condensation of a diacid with a xanthylium ion having appending oxygen substituted benzo rings. A second repeating unit can also be present which is an ester of a diacid and an aliphatic or aromatic diol. Exemplary dicarboxylic acids which can be employed include isophthalic and terephthalic acids, e.g., see column 3, lines 34 and 35. A list of exemplary alkylene gylcols including ethylene glycol, 1,2-propanediol, and 1,3-propanediol can be found at column 5, lines 17–24.

U.S. Pat. No. 3,725,070 issued to Hamb et al. on Apr. 3, 1973—A linear polyester material is disclosed which is esterified with two or more dissimilar diol units and terephthalic acid units. The linear polyesters are useful as supports for photographic elements. A summary of the potential substituent units for each polyester may be found in column 2.

U.S. Pat. No. 3,793,249 issued to Hamb et al. on Feb. 19, 1974—A linear polyester material is disclosed which is esterified with two or more dissimilar diol units and terephthalic acid units. The linear polyesters are useful as supports for photographic elements. A summary of the potential substituent units for each polyester may be found in column 2.

U.S. Pat. No. 3,495,984 issued to Vanpoecke et al. on Feb. 17, 1970—A multilayer photographic film is disclosed which includes a supporting layer comprising a mixture of cellulose triacetate and a polyester of at least one phthalic acid and at least one aliphatic diol. The use of a polyester of isophthalic acid, at least one aliphatic saturated carboxylic acid and at least one aliphatic diol can be found, for example, at column 3, lines 56–63.

Bayer Brochure "ATI 967 d,e", entitled "Application Technology Information, APEC® HT for solubility Applications"—Properties and applications for Apec® HT copolycarbonate resins are disclosed including use as binding agents for organic photoconductors.

CROSS REFERENCE TO COPENDING APPLICATION

U.S. patent application Ser. No. 09/126,169, entitled "IMAGING MEMBER WITH IMPROVED ANTI-CURL BACKING LAYER", filed in the names of K. Carmichael et al., concurrently herewith.—An electrostatographic imaging member is disclosed including an anti-curl layer, a supporting substrate having an electrically conductive layer, at least one imaging layer, an optional ground strip layer and an optional overcoating layer, the anti-curl layer including a polycarbonate film forming polymer binder containing 3,3,5-trimethylcyclohexane groups in the polycarbonate moiety.

Thus, the characteristics of electrostatographic imaging members comprising a supporting substrate, having a conductive surface on one side, coated with at least one photoconductive layer and coated on the other side with an anti-curl layer exhibit deficiencies which are undesirable in automatic, cyclic electrostatographic copiers, duplicators, and printers.

SUMMARY OF THE INVENTION

It is an object of the invention to provide an electrostatographic imaging member which overcomes the above-noted disadvantages.

It is still another object of this invention to provide an electrostatographic imaging member which resists delamination between an anti-curl backing layer and the adjacent supporting substrate.

It is yet another object of this invention to provide an electrostatographic imaging member having an anti-curl layer with improved adhesion to a supporting substrate.

It is a further object of this invention to provide an electrostatographic imaging member with a wear resisting and mechanically robust anti-curl layer.

It is also another object of the present invention to provide improved layered electrostatographic imaging members having a supporting substrate, a charge blocking layer, an optional adhesive layer, a charge generating layer, and a charge transport layer with better adhesion strength for resisting layer delamination.

It is yet another object of the present invention to provide an improved layered flexible electrostatographic imaging web having reduced surface contact friction between the charge transport layer and the anti-curl layer in rolled up webstock.

It is still a further object of the present invention to provide an improved layered flexible electrostatographic imaging web having an anti-curl layer which does not cause ultrasonic horn wear during ultrasonic welding of seams to form belts.

It is also another object of the present invention to provide an improved layered flexible electrostatographic imaging belt that produces high quality images and print copy output.

It is yet another object of the present invention to provide an improved layered flexible electrostatographic imaging belt that prevents belt stall after extensive image cycling.

It is still a further object of the present invention to provide an improved layered flexible electrostatographic imaging belt which prevents the formation of undesirable marks on copies in machines utilizing ROS exposure systems after extensive image cycling.

It is yet another object of the present invention to provide an improved layered flexible electrostatographic imaging belt which eliminates an audible squeaky sound during machine operation.

These and other objects of the present invention are accomplished by providing an electrostatographic imaging member comprising a supporting substrate having an electrically conductive layer, at least one imaging layer, an anti-curl layer, an optional ground strip layer and an optional overcoating layer, the anti-curl layer comprising a film forming polymer binder selected from the group consisting of a polymer represented by the following structural formula:

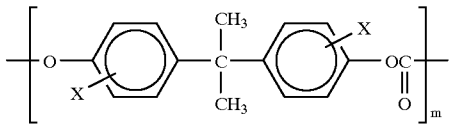

wherein m is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and a polymer represented by the following structural formula:

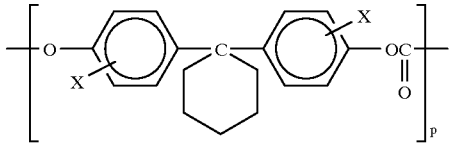

wherein p is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and blends of these polymers, a copolyester adhesion promoter, and dispersed particles selected from the group consisting of inorganic particles, organic particles and mixtures thereof.

Preferably, the electrostatographic imaging member is an electrophotographic imaging member having a hole blocking layer on the conductive layer, an optional adhesive layer on the blocking layer and an imaging layer on either the conductive layer or the optional adhesive layer, the imaging layer comprising a charge generating layer and a charge transport layer. The electrostatographic imaging member is in the shape of a flexible belt which may be utilized in an electrographic or electrophotographic imaging process.

Although the present invention is deemed to encompass both electroreceptor and electrophotographic imaging members, for the purpose of illustration only, the discussion hereinafter will focus primarily on electrophotographic imaging members.

BRIEF DESCRIPTION OF THE DRAWING

A more complete understanding of the imaging device of the present invention purpose can be obtained by reference to the accompanying FIGURE is a schematic cross-sectional view of a typical prior art electrophotographic imaging member.

Since this FIGURE is merely a schematic representation of the present invention, it is not intended to indicate relative size and dimension of an electrophotographic imaging member or components thereof.

DETAILED DESCRIPTION OF THE DRAWING

For illustrative purposes, the invention will be described for electrophotographic imaging members in flexible belt form.

In a typical prior art electrophotographic imaging member shown in the FIGURE, the thickness of the substrate layer 32 depends on numerous factors, including mechanical strength and economical considerations, and thus, this layer for a flexible belt may, for example, have a thickness of at least about 50 micrometers, or of a maximum thickness less than about 150 micrometers, provided there are no adverse effects on the final electrophotographic imaging device.

The conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive 30 layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, a hole blocking layer 34 may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise nitrogen containing siloxanes or nitrogen containing titanium compounds as disclosed, for example, in U.S. Pat. Nos. 4,291,110, 4,338,387, 4,286,033 and 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and preferably has a thickness of less than about 0.2 micrometer.

An optional adhesive layer 36 may be applied to the hole blocking layer. Any suitable adhesive layer may be utilized. One well known adhesive layer comprises a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000 and a $T_g$ of about 32° C. If desired, the adhesive layer may comprise a copolyester resin. The adhesive layer comprising the polyester resin is applied to the blocking layer. Any adhesive layer employed should be continuous and, preferably, have a dry thickness between about 200 micrometers and about 900 micrometers and, more preferably, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical -application techniques include spraying, dip coating, roll coating, wire wound rod coating, and the like. Drying of the deposited coating may be effected by any suitable conventional technique such as oven drying, infra red radiation drying, air drying and the like.

Any suitable photogenerating layer 38 may be applied to the blocking layer 34 or adhesive layer 36, if one is employed, which can thereafter be overcoated with a contiguous hole transport layer 40. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light. The photogenerating materials selected should be sensitive to activating radiation having a wavelength between about 600 and about 700 nm during the imagewise radiation exposure step in a electrophotographic imaging process to form an electrostatic latent image.

Any suitable inactive resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder mature generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 40 may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 40 not only serves to transport holes or electrons, but also protects the photoconductive layer 38 from abrasion or chemical attack and therefor extends the operating life of the photoreceptor imaging member. The charge transport layer 40 should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of illumination.

The active charge transport layer 40 may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multilayer-layer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl) phenylmethane; 4'-4"-bis(diethylamino)-2',2"-dimethyltriphenylmethane, N,N'-bis(alkylphenyl)-[1,1'-biphenyl]4,4'-diamine wherein the alkyl is, for example, methyl, ethyl, propyl, n-butyl, etc., N,N'-diphenyl-N,N'-bis (chlorophenyl)-[1,1'-biphenyl]4,4'-diamine, 1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like. Molecular weights can vary, for example, from about 20,000 to about 1,500,000.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures thereof being incorporated herein in their entirety.

Any suitable and conventional technique may be utilized to mix and thereafter apply the charge transport layer coating mixture to the charge generating layer. Typical application techniques include spraying, dip coating, roil coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used provided that there are no adverse effects.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer is preferably maintained from about 2.1 to 200:1 and in some instances as great as 400:1.

Other layers such as conventional ground strip layer 41 comprising, for example, conductive particles dispersed in a film forming binder may be applied to one edge of the photoreceptor in contact with the conductive layer 30, hole blocking layer, adhesive layer 36 or charge generating layer 38. The ground strip 41 may comprise any suitable film forming polymer binder and electrically conductive particles. Typical ground strip materials include those enumerated in U.S. Pat. No. 4,664,995. The ground strip layer 41 may have a thickness from about 7 micrometers to about 42 micrometers, and preferably from about 14 micrometers to about 23 micrometers.

Optionally, an overcoat layer 42 may also be utilized to improve resistance to abrasion. In some flexible electrophotographic imaging members, an anti-curl layer 33 may be applied to the side opposite the side bearing the electrically active coating layers in order to provide flatness and/or abrasion resistance.

The anti-curl layer of the present invention comprises: a film forming polymer binder selected from the group consisting of a polymer represented by Formula I below:

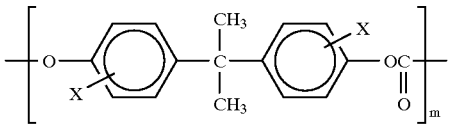

wherein m is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and a polymer represented by Formula II below:

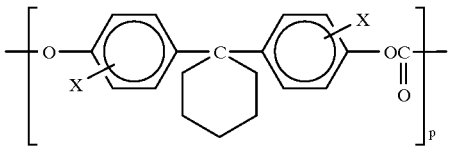

wherein p is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and blends of these polymers, a copolyester adhesion promoter, and dispersed particles selected from the group consisting of inorganic particles, organic particles and mixtures thereof.

The electrophotographic imaging member embodiment of the present invention may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface. The electroreceptor embodiment of this invention may be utilized in any suitable electrographic imaging system in which a shaped electrostatic image is directly formed on a dielectric imaging layer by any suitable means such as styli, shaped electrodes, ion streams, and the like.

The anti-curl layer of this invention exhibits enhanced wear resistance as well as reduced surface contact friction between the anti-curl back coating and the charge transport layer in electrophotographic imaging member webs that are rolled up for storage prior to cutting and seam welding into belts. The anti-curl layer of this invention maintains the optical transmission requirement of the anti-curl layer in the embodiment where light must be transmitted through the layer during electrophotographic imaging processes to ensure back erase.

In the typical anti-curl layer of prior art electrophotographic imaging members, the film forming polymer used is a bisphenol A type polycarbonate of 4,4'-isopropylidene represented by the formula below:

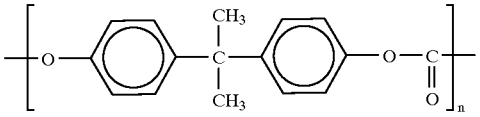

where n is the degree of polymerization.

In some other prior art electrophotographic imaging member embodiments, the film forming polymer used for the anti-curl layer is a poly(4,4'-diphenyl-1,1'-cyclohexane carbonate) having the following formula:

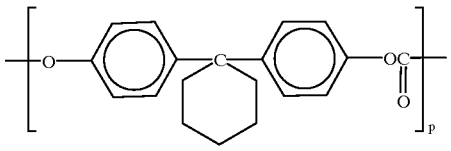

wherein p is the degree of polymerization. Anti-curl containing this polymer are described, for example in U.S. Pat. No. 5,069,993, the entire disclosure incorporated herein by reference. Although anti-curl coatings containing this polymer resist wear somewhat better than anti-curl coatings containing bisphenol A type polycarbonate of 4,4'-isopropylidene, the anti-curl coatings containing the film forming polymers of Formula I and formula II of the present invention are believed to be superior in wear resistance than to either of these prior art anti-curl coatings.

For the anti-curl of the present invention, film forming polymers with wear resisting properties exceeding that of the prior art anti-curl layer polymers are selected from the group consisting of a polymer represented by Formula I below:

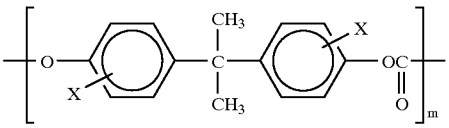

wherein m is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and a polymer represented by Formula II below:

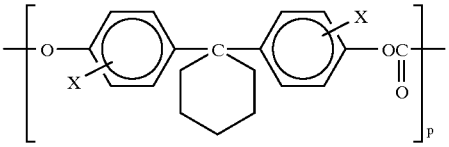

wherein p is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and blends of these polymers.

These film forming polymers have a weight average molecular weight of between about 28,000 and about 230,000. An example of the polymer of Formula I is commercially available from, for example, Mitsubishi Gas Chemical Co. Inc. Polymers of Formula II are also known and described, for example, in U.S. Reissue Pat. 33,724, reissued Oct. 22, 1991, the entire disclosure thereof being incorporated herein by reference. The carbon atoms in the alkyl group of X or the cyclohexyl ring of X in Formula I or Formula II may be unsubstituted and, therefore, be bonded to hydrogen atoms. Thus, from none to all of the hydrogen atoms in the alkyl group of X or the cyclohexyl ring of X in Formula I or Formula II may be substituted with halogen atoms selected from the group consisting of chlorine atoms and fluorine atoms. Preferably, the anti-curl layer of this invention comprises between about 70 and about 99.5 percent by weight of either the polymer of Formula I or Formula II or uniform blends thereof, based on the total weight of the anti-curl layer containing an adhesive promoter and dispersions of an inorganic or organic particles or a dispersion blend of these particles. For an anti-curl layer polymer blend of this invention, the proportions of the polymer of Formula I and the polymer of Formula II can vary infinitely from 100 percent of one of the polymers to 100 percent of the other polymer. Any suitable solvent may be utilized to dissolve the film forming polymers for solvent coating. Typical solvents include, for example methylene chloride, toluene, tetrahydrofuran, chloroethane, chlorobenzene, and the like.

The organic particles, inorganic particles or mixtures thereof utilized in the anti-curl layer of this invention are dispersed in the continuous matrix of the layer. The organic materials have lubricating properties that promote a sliding action between two contacting surfaces thereby reducing frictional force and improving wear resistance of the anti-curl layer. Typical organic particles having lubricating properties include, for example, polytetrafluoroethylene, waxy polyethylene, metal stearates, fatty amides, and the like. The inorganic particles having a hardness of at least 4.0 mohs are hard and have inherent wear resisting properties. Typical hard inorganic particles having wear resisting properties include, for example, micro-crystalline silica, amorphous silica, mineral particles, metal oxides, and the like. Preferably, the inorganic particles are surface treated with a coupling agent to promote better physical and chemical interactions between the dispersed inorganic particles and the matrix polymer binder. Any suitable coupling agent may by utilized. Typical coupling agents include, for example, dimethyl dichloro silane, hexamethyl disilazane, fluorosilane, titanate, zirconate, and the like. The surface of the inorganic particles are rendered hydrophobic by these coupling agents. Although not limited to these materials, two specific exemplary bifunctional silane coupling agents are especially preferred. These preferred coupling agents are chloropropyl triethoxy silane having the molecular formula $Cl(CH_2)_3—Si(OC_2H_5)_3$ and azido silane having the molecular formula $(CH_3CH_2O)_3—Si—R—SO_2N_3$. These organic and inorganic particles are described in U.S. Pat. No. 5,096,795 issued to Yu on Mar. 17, 1992, the entire disclosure thereof being incorporated herein by reference.

It is important to note that both organic and inorganic particles selected for dispersion in the anti-curl layer have a refractive index closely matching that of the film forming polymer binder such that their dispersion in the material matrix of the anti-curl layer does not adversely affect the optical clarity of the resulting layer. Preferably, these particles are present in the anti-curl layer in an amount between about 0.5 percent by weight and 10 percent by weight, based on the total weight of the anti-curl layer after drying. Optimum results are obtained with particle dispersions of between about 1 percent by weight and about 5 percent by weight, based on the total weight of the anti-curl layer. The particles dispersed in the anti-curl layer should have a particle size substantially smaller than the coating layer thickness after drying. Typical average particle sizes are between about 0.1 micrometer and about 5 micrometers.

The anti-curl layer of this invention also contains a copolyester adhesion promoter. Any suitable copolyester may be utilized in the anti-curl layer of this invention. Typical copolyesters applicable for the anti-curl layer of the present invention are described in U.S. Pat. No. 5,021,309, the entire disclosure thereof being incorporated herein by reference. A specific example of a copolyester is Vitel PE-100 is available from Goodyear Tire and Rubber Company. This polyester resin is a linear saturated copolyester of two diacids and ethylene glycol. The ratio of diacid to ethylene glycol in the copolyester is 1:1. The diacids are terephthalic acid and isophthalic acid. The ratio of terephthalic acid to isophthalic acid is 3:2. The Vitel PE-100 linear saturated copolyester consists of alternating monomer units of ethylene glycol and two randomly sequenced diacids in the above indicated ratio and has a molecular weight of about 50,000 and a Tg of about 71° C. Another polyester resin adhesive is Vitel PE-200 available from Goodyear Tire & Rubber Co. This polyester resin is a linear saturated copolyester of two diacids and two diols. The ratio of diacid to ethylene glycol in this copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. Goodyear Vitel PE-200 linear saturated copolyester consists of randomly alternating monomer units of the two diacids and the two diols in the above indicated ratio and has a molecular weight of about 45,000 and a Tg of about 67° C. Other copolyesters such as 49000, available from Morton Chemical may also be used. Preferably, the anti-curl layer of this invention comprises between about 0.5 percent by weight and about 30 percent by weight of the copolyester adhesion promoter, based on the total weight of the anti-curl layer after drying.

PREFERRED EMBODIMENTS OF THE INVENTION

The invention will further be illustrated in the following non-limiting examples, it being understood that these examples are intended to be illustrative only and that the invention is not intended to be limited to the materials, conditions, process parameters and the like recited herein.

CONTROL EXAMPLE I

An electrophotographic imaging member was prepared by providing a 0.02 micrometer thick titanium layer coated on a polyester substrate (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with a ½ mil gap Bird applicator to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

The adhesive interface layer was thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl- 4,4'-diamine were dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 10 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in a forced air oven to form a dry photogenerating layer having a thickness of 2.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbenfabriken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

The approximately 10 mm wide strip of the adhesive layer left uncoated by the photogenerator layer was coated with a ground strip layer. This ground strip layer, after drying at 135° C. in a forced air oven for 5 minutes, had a dried thickness of about 14 micrometers. This ground strip is electrically grounded, by conventional means such as a carbon brush contact device during a conventional xerographic imaging process.

An anti-curl coating was prepared by combining 8.82 grams of polycarbonate resin of 4,4'-isopropylidene diphenol (Makrolon 5705, having a molecular weight of about 120,000 and available from Bayer AG), 0.092 gram of copolyester resin (Vitel PE-100, available from Goodyear Tire and Rubber Company) and 90.1 grams of methylene chloride in a glass container to form a coating solution containing 8.9 percent solids. The container was covered tightly and placed on a roll mill for about 24 hours until the polycarbonate and polyester were dissolved in the methylene chloride to form the anti-curl coating solution. The anti-curl coating solution was then applied to the rear surface (side opposite the photogenerator layer and charge transport layer) of the imaging member with a 3 mil gap Bird applicator and dried at 135° C. for about 5 minutes in a forced air oven to produce a dried film thickness of about 13.5 micrometers and containing approximately 1 weight percent Vital PE-100 adhesion promoter, based on the total weight of the dried anti-curl layer. The resulting electrophotographic imaging member had a structure similar to that schematically shown in FIG. 1 and was used to demonstrate an imaging member having a prior art anti-curl layer control.

CONTROL EXAMPLE II

An electrophotographic imaging member was prepared by following the procedures and using the same materials as described in the Control Example I, except that the polycarbonate resin of the anti-curl layer was substituted with a different polycarbonate, poly(4,4'-diphenyl-1,1'-cyclohexane carbonate), having the following formula:

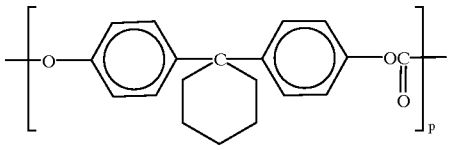

wherein p is the degree of polymerization sufficient to achieve a molecular weight of about 60,000 to give a dried anti-curl coating having a thickness of about 13.5 micrometers. This polymer is available from Mitsubishi Gas Chemical Co. Inc. The prepared imaging member represents another prior art anti-curl control.

EXAMPLE II

An electrophotographic imaging member was prepared by following the procedures and using the same materials as described in the Control Example I, except that the polycarbonate resin of the anti-curl layer was substituted with a polycarbonate molecularly modified from that of Control Example I and having the formula:

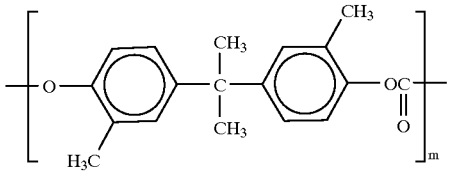

This polycarbonate had a weight average molecular weight of about 120,000. The resulting anti-curl layer of this invention was optically clear like that of the control.

EXAMPLE IV

An electrophotographic imaging member was prepared by following the procedures and using the same materials as described in Example III, except that a 0.28 gram of micro-crystalline silica particles were added into the anti-curl layer solution and dispersed, with the aid of high shear dispersed (Tekmar Dispak Disperser), in a water cooled, jacketed container to prevent overheating and loss of solvent due to evaporation. The particles had an average particle size of about 2.3 micrometers. The resulting anti-curl layer of this invention had a dry thickness of about 13.5 micrometers and contained 3 percent by weight of micro-crystalline silica (available from Malvern Minerals Company) having an average particle size of about 2.5 micrometers, based on the total weight of the dried anti-curl layer. Since the refractive index of the micro-crystalline silica is closely matched to that of the matrix polymer, the dried anti-curl layer was optically clear.

EXAMPLE V

The electrophotographic imaging members of Control Examples I and II as well as Examples III and IV were evaluated for interfacial contact friction between the charge transport layer and the anti-curl layer to assess the surface frictional interaction between these two contacting layers in a 6,000 foot wound up roll of imaging member webstock. The peel strength and wear resistance of the anti-curl layer of each of these imaging members were also investigated for comparison.

The coefficient of friction test was carried out by fastening a sample of an imaging member of each Example to a flat platform surface with the charge transport layer facing upwardly. Another sample of an imaging member from the same Example was secured to the flat surface of the bottom of a horizontally sliding plate weighing 200 grams, the anti-curl layer of the sample facing outwardly away from the sliding plate. The sliding plate was then dragged, with the anti-curl back coating facing downwardly, in a straight line over the platform so that the horizontal anti-curl layer surface moved while in frictional engagement with the horizontal charge transport layer surface. The sliding plate was moved by a cable having one end attached to the plate and having the other end threaded around a freely rotating pulley and fastened to the jaw of an Instron Tensile Tester. The pulley was positioned so that the segment of the cable between the weight and the pulley was parallel to the flat horizontal platform surface. The cable was pulled vertically upward from the pulley by the jaw of the Instron Tensile Tester and the load required to slide the sliding plate, with the anti-curl layer surface against the charge transport layer surface, was monitored using a chart recorder. The coefficient of friction between the charge transport layer and the anti-curl layer was then calculated by dividing the sliding force or load recorded by the chart recorder by 200 grams.

The 180° peel strength was assessed by cutting a minimum of three 0.5 inch (1.2 cm.)×6 inches (15.24 cm.) imaging member samples from each of Control Examples I and II and Examples III and IV. For each sample, the anti-curl layer was partially stripped from the test sample with the aid of a razor blade and then hand peeled to about 3.5 inches from one end to expose the substrate support layer inside the sample. This stripped sample was then secured to a 1 inch (2.54 cm.)×6 inches (15.24 cm.) and 0.05 inch (0.254 cm.) thick aluminum backing plate (having the charge transport layer facing the backing plate) with the aid of two sided adhesive tape. The end of the resulting assembly, opposite the end from which the anti-curl layer was not stripped, was inserted into the upper jaw of an Instron Tensile Tester. The free end of the partially peeled anti-curl layer was inserted into the lower jaw of the Instron Tensile Tester. The jaws were then activated at a one inch/mm. crosshead speed, a two inch chart speed and a load range of 200 grams, to peel the sample at least two inches at an angle of 1800. The load was calculated to derive the peel strength of the sample. The peel strength was determined to be the load required for stripping the anti-curl layer divided by the width (1.27 cm.) of the test sample.

The electrophotographic imaging members of Control Examples I and II and Examples III and IV were also each cut to a size of 1 inch (2.54 cm.) by 12 inches (30.48 cm.) and each tested for resistance to wear of the anti-curl layers. Testing was effected by means of a dynamic mechanical cycling device in which glass tubes were skidded across the surface of the anti-curl layer on each imaging member. More specifically, one end of the test sample was clamped to a stationary post and the sample was looped upwardly over three equally spaced horizontal glass tubes and then downwardly over a stationary guide tube through a generally inverted U shaped path with the free end of the sample secured to a weight which provided one pound per inch width tension on the sample. The outer surface of the imaging member bearing the charge transport layer faced downwardly so that it would periodically be brought into sliding mechanical contact with the glass tubes. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the charge transport layer was in sliding mechanical contact with a single stationary support tube during the testing. The rotation of the spinning disk was adjusted to provide the equivalent of 11.3 inches (28.7 cm.) per second tangential speed. The extent of charge transport layer wear was measured using a permascope at the end of a 330,000 wear cycles test.

The results obtained for coefficient of surface contact friction between the charge transport layer (CTL) and anti-curl layer (ACL), 180° peel strength, and wear resistance are listed in the following Table I:

TABLE I

| Example | Silica in ACL | Coeff. of Friction CTL/ACL | Thickness Peel Strength (gms/cm) | Thickness Wear Off (microns) |
|---|---|---|---|---|
| I (Control) | None | 3.17 | 8.6 | 10.0 |
| II (Control) | None | 2.98 | 10.4 | 6.8 |
| III | None | 2.62 | 48.3 | 5.4 |
| IV | 3% Silica | 0.55 | 54.6 | 2.2 |

The data listed in the table above shows that the coefficient of surface contact friction between the charge transport layer and the anti-curl layer was substantially reduced from 3.17 to 2.62 when the anti-curl layer film forming polymer of the prior art electrophotographic imaging member of Control Example I when the prior art 4,4'-isopropylidene diphenol polycarbonate anti-curl layer was replaced with the film forming polymer component of this invention. It is interesting to note, however, that the other prior art anti-curl layer of Control Example II, utilizing poly(4,4'-diphenyl-1,1'-cyclohexane carbonate) did give a slightly lower charge transport layer and anti-curl layer surface coefficient of contact friction of 2.98 and exhibited improved wear resistance compared to the wear result obtained for Control Example I.

When 3 percent by weight of micro-crystalline silica, based on the total weight of the dried anti-curl layer, was added to the anti-curl layer of this invention, as described in Example IV, the coefficient of surface contact friction was further reduced to a significantly low value of 0.55 and the wear resistance of the resulting anti-curl layer was also significantly improved. The observed coefficient of friction reduction should resolve the puckering and dimples problems seen in conventional electrophotographic imaging member coating layers of either a 6,000 feet roll-up web-stock or a belt configuration storage package.

It should also be noted that the anti-curl layer of this invention, described in Example III, improved the adhesion bond strength of the anti-curl layer to the substrate support, provided reduced surface friction, and gave the best wear resistance of the anti-curl layer against sliding contact than either of the prior art polymers. An additional benefit observed was that the electrophotographic imaging members of Examples III and IV did not cause surface scratching nor exacerbate wear of the ultrasonic horn during seam welding process of imaging belt fabrication.

EXAMPLE VI

An electrophotographic imaging member may be prepared by following the procedures and using the same materials as described in the Control Example II, except that the polycarbonate resin of the anti-curl layer can be substituted with a structurally modified polycarbonate derived from that of Control Example II and having the formula:

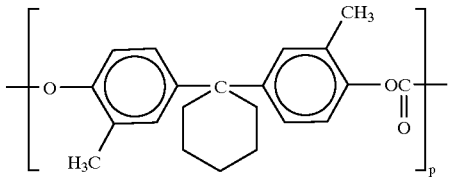

This polycarbonate can have a weight average molecular weight of about 60,000. The resulting anti-curl layer of this invention is expected to be optically clear like that of the control. If desired, 3 percent by weight of organic particles, inorganic particles or blends of these particles having an average particle size of less than about 5 micrometers may also be dispersed into the coating mixture of this anti-curl layer to enhance wear resistance and improve frictional properties.

EXAMPLE VII

An electrophotographic imaging member may be prepared by following the procedures and using the same materials as described in the Control Example I, except that the polycarbonate resin of the anti-curl layer can be substituted with a 50:50 weight ratio blend of a first polycarbonate represented by the formula:

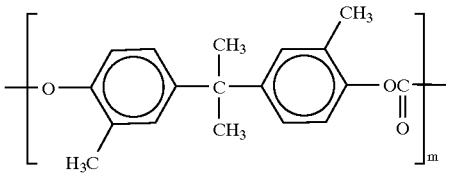

where m is the degree of polymerization and having a weight average molecular weight of about 120,000 and a second polycarbonate represented by the formula:

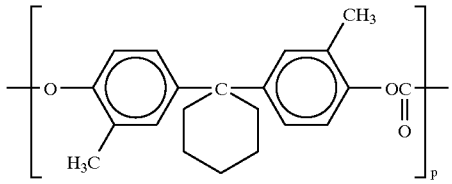

where p is the degree of polymerization and having a weight average molecular weight of about 60,000. The resulting anti-curl layer of this invention is expected to be optically clear like that of the control. If desired, 3 percent by weight of organic particles, inorganic particles or blends of these particles having an average particle size of less than about 5 micrometers may also be dispersed to the coating mixture of this anti-curl layer to enhance wear resistance and frictional property.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising an anti-curl layer, a supporting substrate having an electrically conductive layer, at least one imaging layer, an optional ground strip layer and an optional overcoating layer, the anti-curl layer comprising a film forming polymer binder selected from the group consisting of a polymer represented by Formula I below:

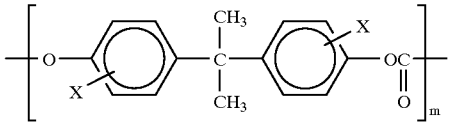

wherein m is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and a polymer represented by Formula II below:

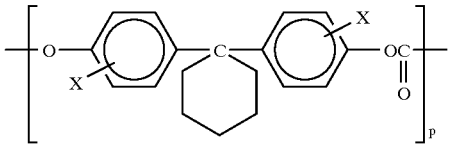

wherein p is an integer between about 100 and about 800 and

X is selected from the group consisting of a halogen atom, a linear substituted or unsubstituted alkyl group containing 1 to 6 carbon atoms, and a substituted or unsubstituted cyclohexyl ring, and blends of these polymers, a copolyester adhesion promoter and dispersed particles selected from the group consisting of inorganic particles, organic particles and mixtures thereof.

2. An electrostatographic imaging member according to claim 1 wherein at least one imaging layer comprises an electrophotographic imaging layer.

3. An electrostatographic imaging member according to claim 2 wherein the electrophotographic imaging layer comprises a charge generating layer and a charge transport layer.

4. An electrostatographic imaging member according to claim 1 wherein at least one imaging layer comprises a dielectric electrographic imaging layer.

5. An electrostatographic imaging member according to claim 1 wherein the anti-curl layer comprises between about 0.5 percent by weight and about 30 percent by weight, based on the total weight of the anti-curl layer, of the copolyester adhesion promoter.

6. An electrostatographic imaging member according to claim 1 wherein the anti-curl layer comprises between about 0.5 percent by weight and 10 percent by weight, based on the total weight of the anti-curl layer, of the inorganic particles.

7. An electrostatographic imaging member according to claim 1 wherein the anti-curl layer comprises between about 0.5 percent by weight and 10 percent by weight, based on the total weight of the anti-curl layer, of the organic particles.

8. An electrostatographic imaging member according to claim 1 wherein the anti-curl layer comprises between about 0.5 percent by weight and 10 percent by weight, based on the total weight of the anti-curl layer, of the mixture of inorganic and organic particles.

9. An electrostatographic imaging member according to claim 1 wherein the anti-curl layer comprises between about 70 and about 99.5 percent by weight, based on the total weight of the anti-curl layer, of the film forming polymer binder represented by the structural formula:

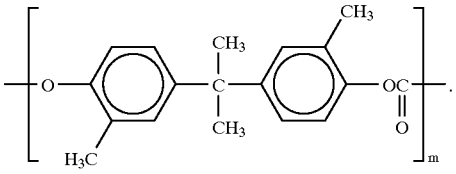

10. An electrostatographic imaging member according to claim 9 wherein the anti-curl layer comprises between about 0.5 percent by weight and about 30 percent by weight, based on the total weight of the anti-curl layer, of the copolyester adhesion promoter.

11. An electrostatographic imaging member according to claim 10 wherein the anti-curl layer comprises between about 0.5 percent by weight and 10 percent by weight, based on the total weight of the anti-curl layer, of the inorganic particles.

12. An electrostatographic imaging member according to claim 10 wherein the anti-curl layer comprises between about 0.5 percent by weight and 10 percent by weight, based on the total weight of the anti-curl layer, of the organic particles.

13. An electrostatographic imaging member according to claim 10 wherein the anti-curl layer comprises between about 0.5 percent by weight and 10 percent by weight, based on the total weight of the anti-curl layer, of the mixture of inorganic and organic particles.

14. An electrostatographic imaging member according to claim 1 wherein the anti-curl layer comprises between about 70 and about 99.5 percent by weight, based on the total weight of the anti-curl layer, of the film forming polymer binder represented by the structural formula:

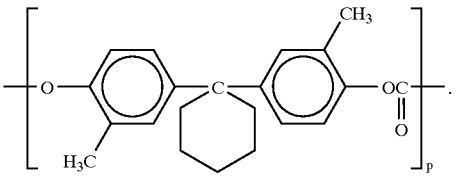

15. An electrostatographic imaging member according to claim 14 wherein the anti-curl layer comprises between about 0.5 percent by weight and about 30 percent by weight, based on the total weight of the anti-curl layer, of the copolyester adhesion promoter.

16. An electrostatographic imaging member according to claim 15 wherein the anti-curl layer comprises between about 0.5 percent by weight and 10 percent by weight, based on the total weight of the anti-curl layer, of the inorganic particles.

17. An electrostatographic imaging member according to claim 15 wherein the anti-curl layer comprises between about 0.5 percent by weight and 10 percent by weight, based on the total weight of the anti-curl layer, of the organic particles.

18. An electrostatographic imaging member according to claim 15 wherein the anti-curl layer comprises between about 0.5 percent by weight and 10 percent by weight, based on the total weight of the anti-curl layer, of the mixture of inorganic and organic particles.

19. An electrostatographic imaging member according to claim 1 wherein the alkyl group of X and the cyclohexyl ring of X in Formula I and Formula II are unsubstituted.

20. An electrostatographic imaging member according to claim 1 wherein the alkyl group of X and the cyclohexyl ring of X in Formula I and Formula II are substituted with halogen atoms selected from the group consisting of chlorine atoms and fluorine atoms.

* * * * *